US006173687B1

(12) United States Patent
Fukuhara et al.

(10) Patent No.: US 6,173,687 B1
(45) Date of Patent: Jan. 16, 2001

(54) HYDRAULIC APPARATUS FOR ADJUSTING THE TIMING OF OPENING AND CLOSING OF AN ENGINE VALVE

(75) Inventors: Katsuyuki Fukuhara, Hyogo; Masafumi Sugawara, Tokyo; Makoto Yamauchi, Tokyo; Chikara Ueno, Tokyo, all of (JP)

(73) Assignee: Mitsubishi Denki Kabushiki Kaisha, Tokyo (JP)

( * ) Notice: Under 35 U.S.C. 154(b), the term of this patent shall be extended for 0 days.

(21) Appl. No.: 09/189,979

(22) Filed: Nov. 12, 1998

(30) Foreign Application Priority Data

Nov. 14, 1997 (JP) ..... 9-314069

(51) Int. Cl.[7] ..... F01L 1/344
(52) U.S. Cl. ..... 123/90.17; 123/90.31
(58) Field of Search ..... 123/90.15, 90.16, 123/90.17, 90.31

(56) References Cited

U.S. PATENT DOCUMENTS

| | | | | |
|---|---|---|---|---|
| 4,858,572 | | 8/1989 | Shirai et al. | 123/90.12 |
| 5,724,929 | * | 3/1998 | Mikame et al. | 123/90.17 |
| 5,794,577 | * | 8/1998 | Kira | 123/90.17 |
| 5,836,275 | * | 11/1998 | Sato | 123/90.17 |

FOREIGN PATENT DOCUMENTS

| | | |
|---|---|---|
| 0 801 212 A1 | 10/1997 | (EP) . |
| 2-50105 | 4/1990 | (JP) . |
| 9-60507 | 3/1997 | (JP) . |
| 9-236003 | 9/1997 | (JP) . |
| 9-250310 | 9/1997 | (JP) . |
| 9-250311 | 9/1997 | (JP) . |
| 9-250312 | 9/1997 | (JP) . |
| 9-280017 | 10/1997 | (JP) . |
| 9-280018 | 10/1997 | (JP) . |
| 9-280019 | 10/1997 | (JP) . |
| 9-287420 | 11/1997 | (JP) . |
| 9-324613 | 12/1997 | (JP) . |
| 10-159517 | 6/1998 | (JP) . |
| 10-227236 | 8/1998 | (JP) . |
| 11-62521 | 3/1999 | (JP) . |
| 11-81927 | 3/1999 | (JP) . |
| 11-241608 | 9/1999 | (JP) . |

* cited by examiner

*Primary Examiner*—Wellun Lo
(74) *Attorney, Agent, or Firm*—Sughrue, Mion, Zinn, Macpeak & Seas, PLLC

(57) ABSTRACT

A hydraulic apparatus for adjusting the timing of opening and closing of an engine valve includes a cam shaft driven to rotate in synchronization with the engine rotation. An actuator is installed on the cam shaft for changing the timing of opening and closing of an intake valve and/or exhaust valve using a control of a working oil supply. A slidable plunger is disposed in the actuator, and a rotor is disposed in the actuator to engage with the plunger by an engaging hole. A spring urges the plunger to move into the engaging hole to make an engagement therebetween when the engine is stopped, and when the engine begins to run, the working oil is supplied into the engaging hole to push out the plunger from the engaging hole to release the engagement between a housing of the actuator and the rotor. The engaging hole and the plunger have a surface parallel with a slide direction of the plunger, and a clearance therebetween is smaller than 0.17 mm when the engaging hole and plunger engage each other.

5 Claims, 7 Drawing Sheets

HYDRAULIC APPARATUS FOR ADJUSTING THE TIMING OF OPENING AND CLOSING OF AN ENGINE VALVE

BACKGROUND OF THE INVENTION

1. Field of the Invention

The present invention relates to a hydraulic apparatus for adjusting the timing of the opening and closing of one or both engine valves, the intake valve and/or the exhaust valves of an engine using an actuator, according to the operating state of the engine.

2. Description of the Prior Art

Such hydraulic apparatuses for adjusting the timing of opening and closing of an engine valve are disclosed, as prior art, in JP7-139319A, JP7-139320A, JP8-28219A, JP8-121122A, JP9-60507A, JP9-60508A in which cam shafts are driven using a timing pulley synchronized with the engine crank shaft and a chain sprocket. A vane type valve timing mechanism which is arranged between the timing pulley and the cam shaft is driven by an actuator using a working oil provided from an oil pump through an oil control valve (hereinafter to be called "OCV"), so as to rotate the cam shaft relative to the crank shaft for advancing or retracting the cam shaft rotation relative to the crank shaft rotation. Thus, the timing of the opening or closing of the engine valve relative to the engine shaft rotation is shifted for the purpose of reducing exhaust gases and improving fuel efficiency.

A plunger in the actuator employed in such hydraulic apparatuses of the prior art is formed as a tapered pin, having an acute cone angle. Such a plunger is disclosed as a stopper pin, for example, in JP9-60508A.

In the hydraulic apparatuses having such a structure for adjusting the timing of the opening and closing of an engine valve in the prior art, a relatively large clearance is required between the tapered surface of the plunger and its engaging hole.

When the engine begins running from a state in which the engine is stopped with the plunger engaged with the hole, humming results in the engine. In turn this causes unpleasant noises. Additionally, when the tapered surface of the plunger is engaging with the hole, the engaging surface is inclined with respect to the rotation axis, and this causes a partial force urging the plunger in a direction of detachment. Thus, there is a tendency for the plunger to fall off.

SUMMARY OF THE INVENTION

An object of the present invention is to avoid the aforementioned problems, and to propose a hydraulic apparatus for adjusting the timing of the opening and closing of an engine valve having a plunger structure, by which humming is not caused by the rotor of the engine, due to the clearance between the plunger and the hole, when the engine starts running from a state in which the engine is in a stopped state.

A hydraulic apparatus for adjusting the, timing of opening and closing of an engine valve according to the present invention contains:

a cam shaft driven to rotate in synchronization with the engine rotation;

an actuator installed on the cam shaft for changing the timing of the opening and closing of a valve using a control of a working oil supply so as to change the timing of opening and closing of the intake valve and/or the exhaust valve;

a slidable plunger disposed in the actuator;

a rotor disposed in the actuator, to engage with the plunger by an engaging hole;

and a spring to urge the plunger to move into the engaging hole to make an engagement therebetween, when the engine is stopped, and when the engine begins to run, working oil is supplied into the engaging hole to push out the plunger from the engaging hole, to release the engagement between the housing and the rotor;

wherein the engaging hole and the plunger having a surface parallel with the slide direction of the plunger, and the clearance therebetween is smaller than 0.17 mm when they are engaging with each other.

In an embodiment of the present invention, the slide direction of the plunger is parallel with the direction of the cam shaft.

In an embodiment of the present invention, the plunger is installed in the housing, and the engaging hole is disposed in the rotor.

In an embodiment of the present invention, the plunger is installed in the rotor, and the engaging hole is disposed in the housing.

In an embodiment of the present invention, the whole engaging portion is parallel with the slide direction of the plunger.

In an embodiment of the present invention, the plunger has a recess at its tip portion. The recess functions as a reservoir of debrit in the working oil to prevent the entering of small particles into the clearance space between the plunger and the engaging hole.

In an embodiment of the present invention, the clearance between the plunger and its engaging hole is less than 0.17 mm, when they are engaging with each other.

DETAILED DESCRIPTION OF THE PREFERRED EMBODIMENTS

An embodiment of the present invention is described below.

Embodiment 1

Figure 1:
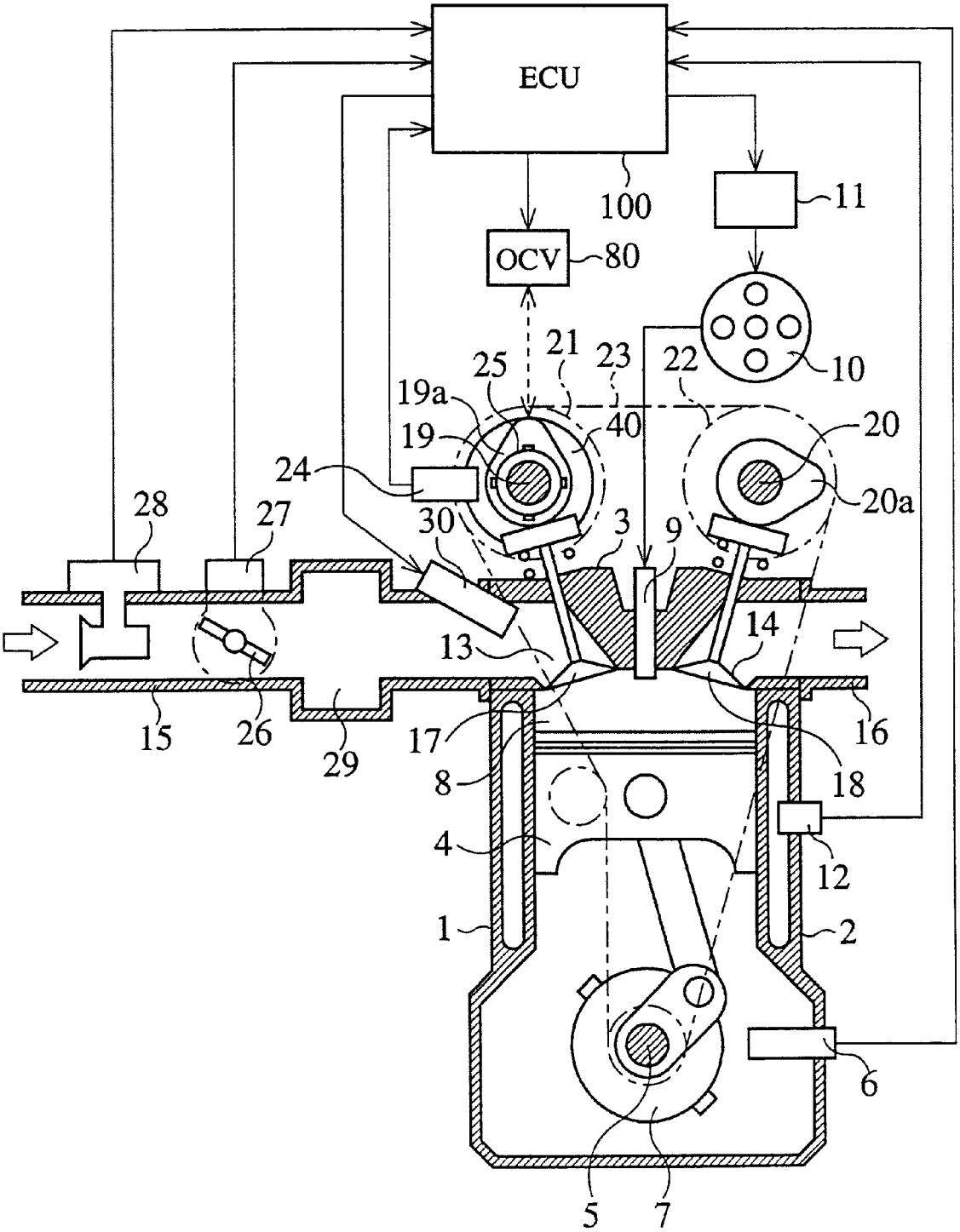
FIG. 1 is a schematic cross sectional view of a gasoline engine system provided with a hydraulic apparatus for adjusting the timing of opening and closing of an engine valve according to the first embodiment of the present invention.

FIG. 1 is a schematic cross sectional view of a gasoline engine system provided with a hydraulic apparatus for adjusting the timing of the opening and closing of an engine valve in the first embodiment of the present invention. In the figure, 1 denotes an engine having a plurality of cylinders, only one of which is shown. 2 is a cylinder block forming a cylinder of the engine 1, 3 is a cylinder head arranged at the upper portion of the cylinder block 2, 4 is a piston which moves up and down in each cylinder of the cylinder block 2, 5 is a crank shaft connected to the lower end of the piston 4, the crank shaft 5 is driven to rotate by the vertical movement of the piston 4.

6 is a crank angle sensor for detecting the rotation rate of the engine 1 and for detecting whether the crank shaft 5 is in the predetermined angle position or not. 7 is a signal rotor connected with the crank shaft 5, which has two teeth on its periphery at each 180° position. The crank angle sensor 6 generates a pulse as a crank angle detection signal, every time one of the teeth passes in front of the sensor 6.

8 is a combustion chamber in which the fuel-air mixture burns, the chamber 8 is contoured by the inner surface of the cylinder block 2 and the cylinder head 3 as well as the upper portion of the piston 4. 9 is a ignition plug to ignite the fuel-air mixture in the combustion chamber 8, the plug 9 is installed at the upper portion of the cylinder head 3 and protrudes into the combustion chamber 8. 10 is a distributor connected to an exhaust side cam shaft 20, which will be explained later. 11 is an igniter for generating a high voltage. Each ignition plug is connected with the distributor 10 through a wire line (not shown) for high voltage. The high voltage generated in the igniter 11 is distributed by the distributor 10 to each ignition plug 9, in synchronization with the rotation of the crank shaft 5.

12 is a temperature sensor of a coolant water installed in the cylinder block 2 for detecting the temperature of coolant water (coolant water temperature ) THW which flows through a coolant water channel. 13 and 14 are, respectively, an intake port and an exhaust port made in the cylinder head 3. 15 and 16 are, respectively, an intake channel communicating with the intake port 13 and an exhaust channel communicating with the exhaust port 14. 17 is an intake valve arranged in the cylinder head 3 for opening and closing the intake port 13. 18 is an exhaust valve arranged in the cylinder head 3 for opening and closing the exhaust port 14.

19 is an intake side cam shaft arranged over the intake valve 17. 19*a* is an intake side cam, which can rotate in synchronization with the intake side cam shaft 19, for opening or closing the intake valve 17. 20 is an exhaust side cam shaft arranged over the exhaust valve 18. 20*a* is an exhaust side cam, which can rotate in synchronization with the exhaust side cam shaft 20, for opening or closing the exhaust valve 17. 21 is an intake side timing pulley arranged at an end of the intake side cam shaft 19. 22 is an exhaust side timing pulley arranged at an end of the exhaust side cam shaft 21. 23 is a timing belt for linking the timing pulleys 21, 22 with the crank shaft 5.

When the engine 1 rotates, the rotational force is transmitted from the crank shaft 5 to each cam shaft 19,20 through the timing belt 23, and each of the timing pulleys 21,22. Each cam 19*a*, 20*a* rotates together with the each cam shaft 19,20 as a single body, and the intake valve 17 and the exhaust valve 18 are driven to be opened or closed in synchronization with the rotation of the crank shaft 5 and the up and down movement of the pistons 4, i.e., driven with a predetermined timing in synchronization with the four phases of the engine 1, including an intake phase, a compression phase an explosion and expansion phase and an exhaust phase of the engine.

Reference numeral 24 denotes a cam angle sensor, disposed near the intake side cam shaft 19 for detecting the actual timing of opening and closing of the intake valve 17 (valve timing). 25 is a signal rotor linked with the intake side cam shaft 19. Four teeth are formed on the peripheral surface of the signal rotor 25 at each 90° position. The cam angle sensor 24 generates a pulse as a cam angle signal, when one of these teeth passes in front of this sensor.

26 is a throttle valve disposed in the intake channel 15. The amount of intake air is adjusted by the opening or closing of the valve 26, which is linked with an acceleration pedal (not shown). 27 is a throttle sensor linked with the throttle valve 26 for detecting the degree of opening of the throttle valve TVO. 28 is an intake air sensor, disposed at a position upstream of the throttle valve 26, for detecting the air flow rate AQ (air amount) to be provided into the engine 1. 29 is a surge tank, disposed at a position downstream of the throttle valve 26, to suppress the pulsation of intake air. 30 is an injector, disposed near to the intake port 13 of each cylinder, which delivers fuel into the combustion chamber 8. The injector 30 includes a solenoid valve, which opens when an electric current is provided. Fuel is urged to be pressed into the port 13 by a pressure of a fuel pump (not shown).

When the engine 1 runs, air is provided into the intake channel 15, simultaneously, fuel is injected from each injector towards the intake port 13. As a result, a fuel-air mixture is formed in the intake port 13. When the intake valve 17 is opened at the intake phase of the engine, the fuel-air mixture is delivered into the combustion chamber 8.

Reference numeral 40 is an actuator linked with the intake side cam shaft 19 for changing the valve timing. The working oil of this actuator 40 is lubrication oil of the engine. The actuator 40 is driven by the working oil to change the angle position of the intake side cam shaft 19 relative to the intake timing pulley 21, which causes a continuous change of the valve timing of opening and closing of the intake valve 17. Its detailed structure and function will be explained later.

Reference numeral 80 is an OCV, namely, an oil control valve, for controlling the amount of oil to be provided into the actuator 40. Its structure and function will be explained later.

Reference numeral 100 denotes an electronic control unit (called "ECU" hereinafter), which drives the injector 30, the igniter 11, and the OCV 80 according to the signals mainly from the intake air sensor 28, the throttle sensor 27, the temperature sensor of the coolant water 12, the crank angle sensor 6 and the cam angle sensor 24. The ECU controls the amount of fuel injection, the ignition timing, and the timing of opening and closing of valves, as well as controls the closing time of the OCV 80 after the ignition switch is set in the TURN OFF position, which will be later explained. In addition, the structure and function of the ECU will be explained later.

Figure 2:
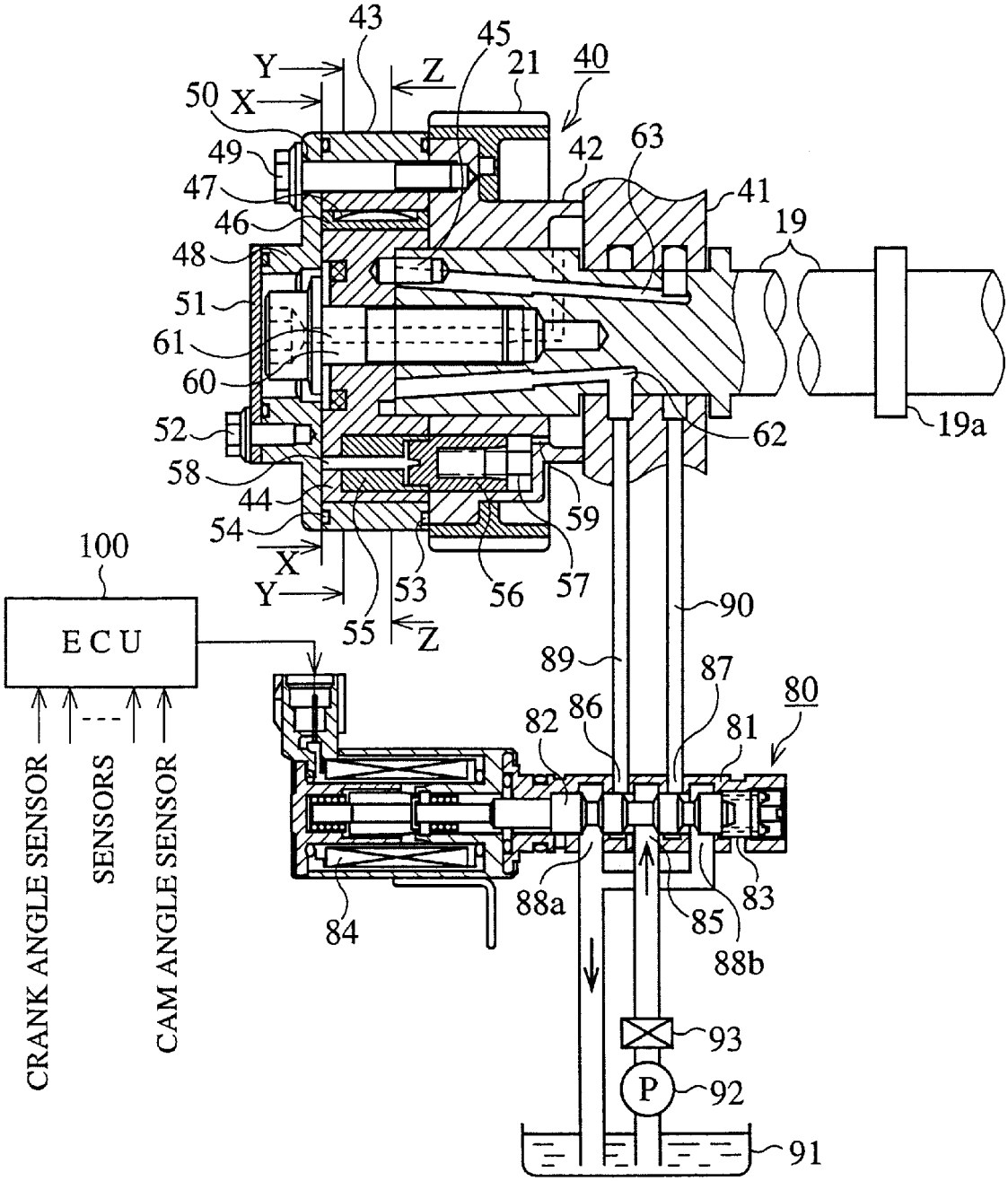
FIG. 2 is a cross sectional view of a hydraulic apparatus for adjusting the timing of opening and closing of an engine valve in the first embodiment of the present invention.
Figure 3:
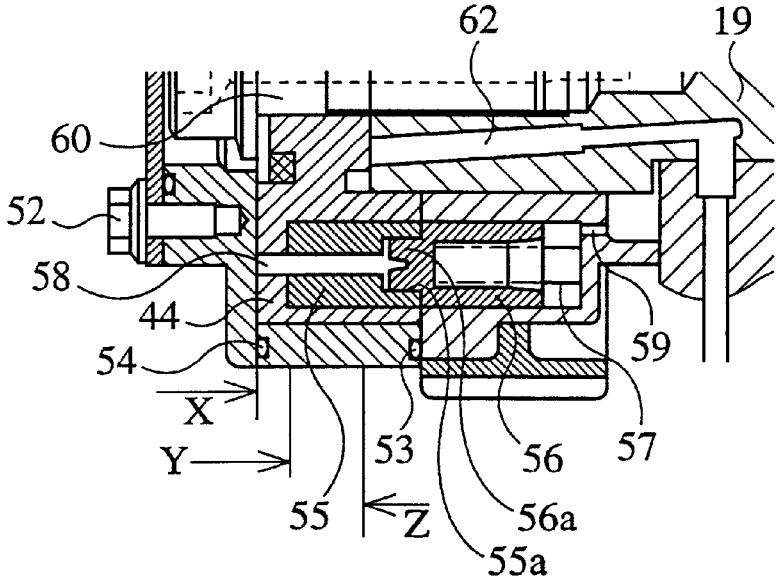
FIG. 3 is a detailed cross sectional view of the principal part of the plunger in FIG. 2.
Figure 4:
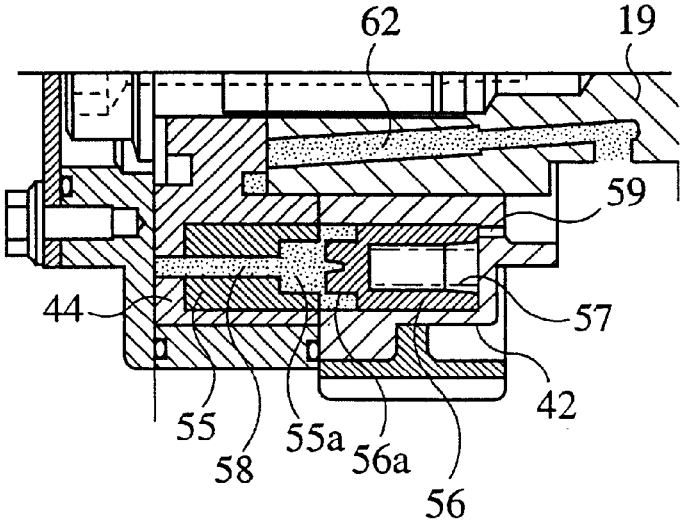
FIG. 4 is a cross sectional view of a hydraulic apparatus for adjusting the timing of opening and closing of an engine valve, shown in FIG. 3, in the state that the plunger in the figure is impelled by a hydraulic force.

FIG. 2 is a cross sectional view of a hydraulic apparatus for adjusting the timing of the opening and closing of an engine valve in the first embodiment of the present invention. FIG. 3 is a detailed cross sectional view of the principal part of the plunger in FIG. 2. FIG. 4 is a cross sectional view of a hydraulic apparatus for adjusting the timing of the opening and closing of an engine valve, shown in FIG. 3, in the state that the plunger in the figure is impelled a hydraulic force. In these figures, reference numeral 40 is an actuator for adjusting the valve timing of the intake valve 17. Its structure and the function are explained below. The elements equivalent to those in FIG. 2 are provided with similar reference numerals, and their explanation is omitted.

In FIG. 2, reference numeral 41 denotes a bearing of the intake side cam shaft 19. 42 is the housing of the actuator 40, which is fixed to the intake side cam shaft 19 and can pivot therearound. 43 is a case fixed to the housing 42. 44 is a vane type rotor fixedly connected to the intake side shaft 19 by means of a bolt 45 and received in the housing 42. This rotor 44 can rotate relative to the case 43. 46 is a chip seal disposed between the case 43 and rotor 44, so as to prevent oil flow between hydraulic chambers contoured by the case 43 and the rotor 44.

47 is a back spring, disposed between the case 43 and the chip seal 46, which is composed of a plate spring urging the chip seal 46 towards the rotor 44. 48 is a cover fixed to the case 43. 49 is a bolt to fix the housing 42 , the case 43 and the cover 48. 50 is an O-ring to prevent an outward oil leakage through the gap between the bolt 49 and the hole. 51 is a plate fixed to the cover 48 by a screw 52. The housing of the actuator is composed of the housing 42, case 43 and cover 48.

53 is an O-ring, disposed between the housing 42 and the case 43 for preventing oil leakage. 54 is an O-ring disposed between the case 43 and the cover 43 for preventing an oil leakage. 55 is a cylindrical holder which is disposed in the rotor 44, and which has an engaging hold 55*a* (FIG. 3) at an end of its longitudinal axis so as to engage with a plunger 56. The plunger 56 will be explained below. This recess 55*a* is a hole parallel with the intake side cam shaft 19.

56 is a slidable plunger installed in the housing 42. The plunger has a protruding part 56*a* (FIG. 3) for engaging with the engaging hole 55*a* in the holder 55. The protruding part 56*a* is formed as a parallel pin having a constant diameter at its whole length, and being parallel with the intake side cam shaft 19. The diameter is equal to that of the engaging hole 55*a* in its engaging portion. That is to say, the plunger 56 is a parallel pin having no tapered surface, at least at its protruding part 56*a*. Thus, the clearance between the protruding part 56*a* and the engaging hole 55*a* can be made small, when the protruding part 56*a* is engaging with the engaging hole 55*a*. The plunger 56 has a recess at its tip, which functions as a reservoir of debris in the working oil.

57 is a spring for urging the plunger towards the holder 55. 58 is an plunger oil channel for introducing the working oil into the holder 55. When the plunger 56 is shifted against the spring 57, by introducing working oil into the hole 55*a* of the holder 55 from the plunger oil channel 58, the locking of the plunger 56 to the holder 55 is cancelled.

59 is an air hole in the housing 42 to maintain constant the pressure at the spring 57 side of the plunger 57 equal to atmospheric pressure. 60 is an axial bolt for connecting the intake side cam shaft 19 and the rotor 44 to each other at their axial center portion. This axial bolt 60 can rotate relative to the cover 48. 61 is an air hole provided in the axial bolt 60 and in the intake side cam shaft 19, to maintain the pressure of the inner side of the plate 51 to be identical to atmospheric pressure.

62 is a first oil channel made in the intake side cam shaft 19 and in the rotor 44. The first oil channel 62 is connected to a timing retard oil pressure chamber 73 (FIG. 5) so as to shift the rotor towards the timing retard direction. 63 is a second oil channel made also in the intake side cam shaft 19 and in the rotor 44. The second oil chamber 63 is connected to a timing advance oil pressure chamber 74 (FIG. 5) so as to shift the rotor towards the timing advance direction. The chambers 73 and 74 will be explained later.

It is possible to install the plunger 56 in the rotor 44 and to dispose the engaging hole 56*a* in the housing 42, in place of installing the plunger 56 in the housing 42 and disposing the engaging hole 56*a* in the rotor 44.

The structure of the OCV 80 (oil control valve), for controlling the pressure of the working oil to be supplied to the actuator 40 in FIG. 2, the structure of which is explained above, is explained below.

81 is a housing of the OCV 80 (to be called "valve housing" hereinafter). 82 is a spool which slides in the valve housing 81. 83 is a spring for urging the spool 82 in one direction. 84 is a linear solenoid to move the spool 82 against the biasing force of the spring 83. 85 is a supply port (input port) made in the valve housing 81. 86 is an A port (output port) made in the valve housing 81. 87 is a B port (output port) made in the valve housing 81. 88*a* and 88*b* are drain ports made in the valve housing 81. 88 is a common drain port connected with the drain ports 88*a* and 88*b*. 89 is a first channel connecting the first oil channel 62 and the A port. 90 is a second channel connecting the second oil channel 63 and the B port. 91 is an oil pan. 92 is an oil pump. 93 is an oil filter.

The suction side of the oil pump 92 is connected into the oil pan 91, and the discharge side is connected with the supply port 85 through the oil filter 93. The drain channel 88 is introduced into the oil pan 91.

The oil pan 91, oil pump 92 and the oil filter 93 constitute the lubrication system of the engine 1. Simultaneously, they constitute, co-operating with the OCV 80, a working oil supplying system to the actuator 40.

Figure 5:
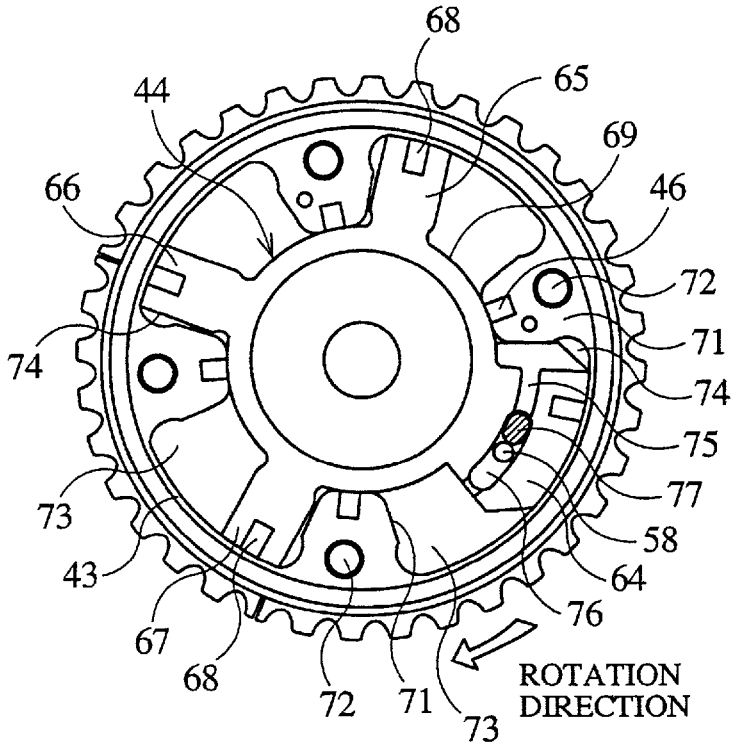
FIG. 5 is an cross sectional view of FIG. 3 along line X—X.
Figure 6:
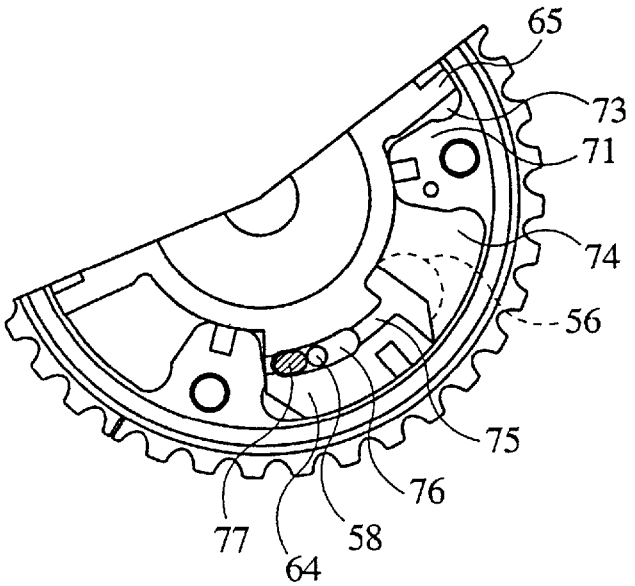
FIG. 6 is a partial cross sectional view of FIG. 5, shown in the state that the slide plate in the figure is shifted.
Figure 7:
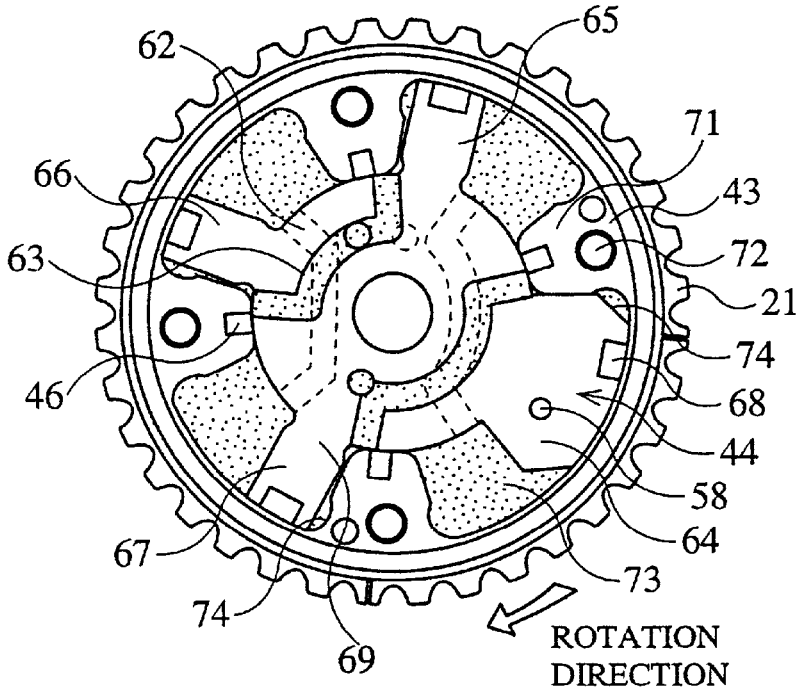
FIG. 7 is a cross sectional view of FIG. 3 along line Y—Y.
Figure 8:
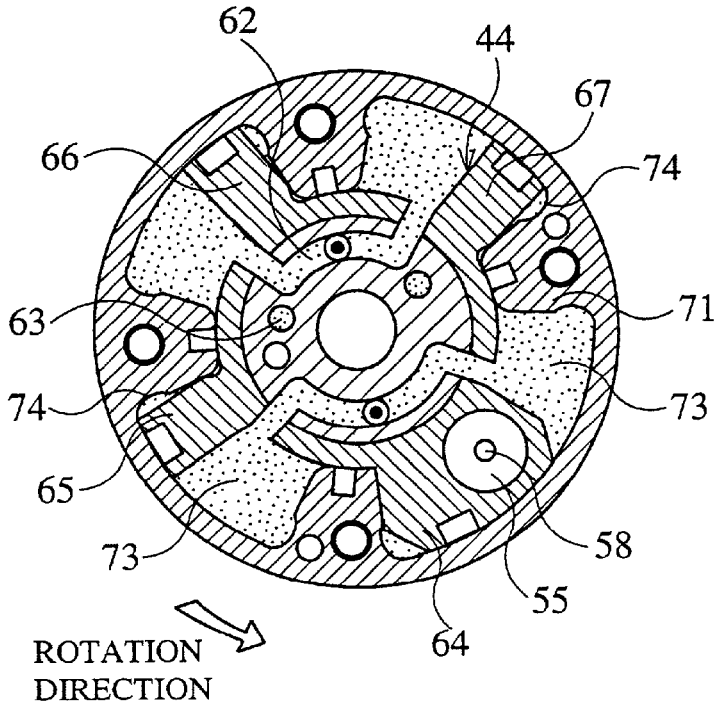
FIG. 8 is a cross sectional view of FIG. 3 along line Z—Z.

FIG. 5 is a cross sectional view of FIG. 3 along the line X—X. FIG. 6 is a partial cross sectional view of FIG. 5 showing the slide plate in FIG. 5 as shifted. FIG. 7 is a cross sectional view of FIG. 3 along the line Y—Y. FIG. 8 is a cross sectional view of FIG. 3 along the line Z—Z.

In these figures, reference numerals 64–67 are the first to fourth vanes projecting in the radial direction from the rotor 44. The tips of these vanes 64–67 slide along the inner surface of the case 43, contacting with it. A chip seal 68 is arranged at the sliding portion of each vane.

71 are a plurality of shoes (four shoes in this figure), projecting from the inner surface of the case 43 equidistantly. 72 are bolt holes disposed in the shoes 71, into which the bolts 49 in FIG. 2 are inserted. The tips of the shoes 71 contact with a vane supporting member 69, and slide along it. The vane supporting member 69 is the center portion of the rotor 44. The chip seals 46, mentioned in relation to FIG. 2, are arranged at the tip portion.

73 is a timing retard oil pressure chamber for rotating the first to fourth vanes 64–67 towards the timing retard direction. 74 is a timing advance oil pressure chamber for rotating the first to fourth vanes 64–67 towards the timing advance direction. These oil chambers 73 and 74 are formed between the case 43 and the rotor 44 as sector-like rooms.

75 is a connecting channel made in the first vane 64 for connecting the timing retard oil pressure chamber 75 and the timing advance oil pressure chamber 74 at the both sides of this vane. 76 is a displacement groove formed as a recess made in the connecting channel 75. The plunger oil channel 58 communicates with an intermediate part of the displacement groove 76. 77 is a slide plate dividing the displacement groove 76 into two parts for preventing oil leakage between the timing retard oil pressure chamber 73 and the timing advance oil pressure chamber 74. The slide plate 77 can move in the displacement groove. That is to say, the slide plate 77 moves towards the timing advance oil pressure chamber 73, as shown in FIG. 6, when the pressure in the timing retard oil pressure chamber 73 is higher. On the other hand, when the pressure in the timing advance oil pressure chamber 74 is higher, the plate moves towards the timing retard oil pressure chamber 73. 68 is a chip seal arranged on each vane 64–67, for sealing between the case 43 and each vane 64–67 so as to protect the oil leakage. The arrows in FIGS. 5,7,8 represent the rotation direction of the actuator 40 as a whole.

The timing retard oil pressure chamber 73 and the timing advance oil pressure chamber 74 are contoured by the housing 42, the case 43, the rotor 44 and the cover 48. The timing retard oil pressure chamber 73 communicates with the first oil channel 62, through which a working oil is supplied into the chamber 73. The timing advance oil pressure chamber 74 communicates with the second oil channel 63, through which a working oil is supplied into the chamber 74. Corresponding to the amount of the working oil supplied into these chambers 73 and 74, the rotor 44 rotates relatively to the housing 42, and as a result, the volumes of the timing retard oil chamber 73 and the timing advance oil chamber 74 change respectively.

The operations of the actuator 40 and the OCV 80 are explained below.

When the engine 1 is stopped, the rotor 44 is positioned at the maximum timing retard position, as shown in FIG. 5, in other words, the rotor is found at the position at the maximum rotated in the timing advance direction relative to the housing 42. The oil pump 92 is stopped as well. Thus, no working oil is supplied into the first oil channel 62, the second oil channel 63, nor the plunger oil channel 58. Then the oil pressure in the actuator 40 is low. As a result, the plunger 56 is pressed against the holder 55 by the spring 57. In this state, the plunger 56 and the holder 55 are engaged with each other and the housing 42 and the rotor 44 are in a locked state.

When the engine 1 begins to run starting from this state, the oil pump 92 works to increase the pressure of the working oil supplied into the OCV 80. Then a working oil is supplied into the timing retard oil pressure chamber 73 from the A port of the OCV 80 through the first channel 89 and the first oil channel 62. The oil pressure in the timing retard oil pressure chamber 73 causes a displacement of the slide plate 77 towards the timing advance oil pressure chamber 74, then the timing retard oil pressure chamber 73 communicates with the plunger oil channel 58.

As a result, working oil is supplied into the engaging hole 55*a* of the holder 55 from the plunger oil channel 58, and as a result, the plunger 56 is pushed against the biasing force of the spring 57 so that the protruding part 56*a* of the plunger 56 falls out from the engaging hole 55*a* of the holder 55. In this manner, the locking between the plunger 56 and the rotor 44 is cancelled.

Because working oil is supplied into the timing retard oil pressure chamber 73, the vanes 64–67 of the rotor 44 are pressed into contact with the shoe 71. Consequently, the housing 42 and the rotor 44 are in abutment with each other due to the oil pressure in the timing retard oil pressure chamber 73, even after the cancellation of the locking. Thus, vibration or shock can be eliminated or reduced.

Because the plunger 56 can be displaced by the oil pressure in the timing retard oil pressure chamber 73, the locking between the plunger 56 and rotor 44 can be cancelled when a predetermined oil pressure (sufficient to displace the slide plate 77 and the plunger 56) is obtained after starting the engine 1, as explained above. This makes it possible to rotate the rotor 44 in the timing advance direction immediately, at any time when it becomes necessary.

When the B port of the OCV 80 is opened to rotate the rotor 44 towards the timing advance direction, a working oil is supplied into the timing advance oil chamber 74 from the second channel 90 through the second oil channel 63. Then the working oil flows into the connecting channel 75 to press the slide plate 77. As a result, the slide plate 77 moves towards the timing retard oil pressure chamber 73 . As a result of this movement of the slide plate 77, the plunger oil channel 58 communicates with the connecting channel 75 at the timing advance oil pressure chamber 74 side. Then working oil is supplied into the plunger oil channel 58 from the timing advance oil pressure chamber 74 to displace the plunger 56 towards the housing 42 side against the biasing force of the spring 57, thus, the locking between the plunger 56 and the holder 55 is cancelled.

By adjusting the oil amounts in the timing retard oil pressure chamber 73 and the timing advance oil chamber 74, in this lock-cancelled state, by opening or closing the A port and B port of the OCV 80 so as to adjust the oil supply, it is possible to rotate the rotor 44 towards the timing advance direction (FIG. 7) or towards the timing retard direction relative to the rotating housing 42 (FIG. 8). For example, when the rotor 44 is rotated up to the maximum timing advance position, each vane of the rotor 44 rotates, in such a state that they are contacting with the shoe 71 of the timing retard oil pressure chamber 73 side, as shown in FIG. 6.

When the oil pressure in the timing retard oil pressure chamber 73 is greater than that in the timing advance oil pressure chamber 74, the rotor 44 rotates towards the timing retard direction relative to the housing 42. In this manner, it is possible to adjust the timing advance or the timing retard of the rotor 44 relative to the housing 42, by adjusting the oil supply to the timing retard oil pressure chamber 73 and the timing retard oil pressure chamber 74.

The supply oil pressure of the OCV 80 can be controlled by the ECU 100, on the basis of the output of relative rotation angle of the rotor 44 against the housing 42, which is detected by a position sensor, and the output of the crank angle sensor, which determines the pressure of the oil pump 92. The ECU 100 will be explained later.

Figure 9A:
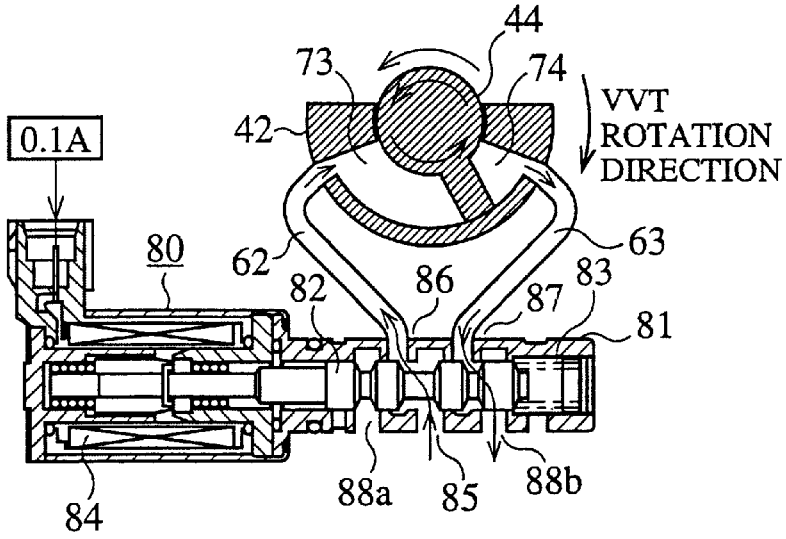
FIGS. 9*a*–9*c* show representative operation states of the oil control valve.
Figure 9B:
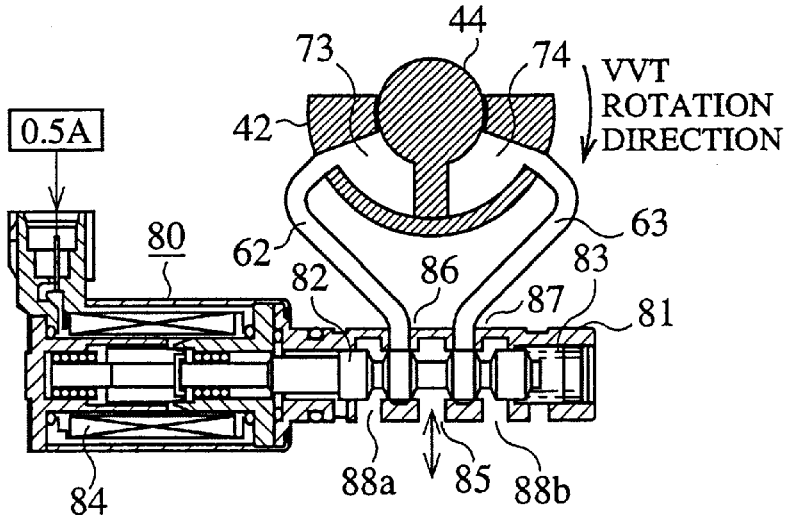
Figure 9C:
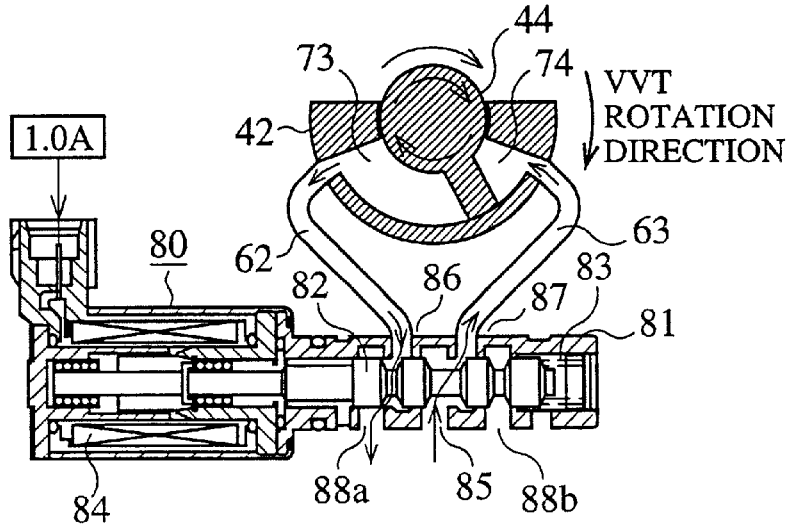

FIGS. 9(*a*)–(*c*) show representative operation states of the oil control valve. FIG. 9(*a*) shows an example of the control current from the ECU 100 being 0.1 A. The spool 82 is pressed up to the left end of the valve housing 81, as a result, the supply port 85 and the A port 86 communicate to each other, and the B port 87 and the drain port 88*b* communicate to each other. In this state, working oil is supplied into the timing retard oil pressure chamber 73, on the other hand, the oil in the timing advance oil pressure chamber 74 is exhausted. Consequently, the rotor 44 in FIG. 9(*a*) rotates counterclockwise against the rotating housing 42. This means that the phase of the intake side cam shaft 19 is retarded against the phase of intake side timing pulley 21, i.e., a timing retard control is realized.

FIG. 9(*b*) shows an example of the control current from the ECU 100 being 0.5 A, in which the forces of the linear solenoid 84 and the spring 83 are in balance; the spool 82 is maintained at a position where the spool 82 closes both of the A port 86 and the B port 87; working oil is not supplied nor exhausted to and from the timing retard oil pressure chamber 73 nor the timing advance oil chamber 74. In this state, if there is not any oil leakage from the timing retard oil pressure chamber 73 nor from the timing advance oil pressure chamber 74, the rotor 44 is held at this position, and the phase relation between the intake side timing pulley 21 and intake side cam shaft 19 remains unchanged.

FIG. 9(*c*)shows an example of the control current from the ECU 100 being 1.0 A. The spool 82 is pressed up to the right end of the valve housing 81, as a result, the supply port 85 and the B port 87 communicate to each other, and the A port 86 and the drain port 88*a* communicate to each other. In this state, working oil is supplied into the timing advance oil pressure chamber 74, on the other hand, the oil in the timing retard oil pressure chamber 73 is discharged. Consequently, the rotor 44 in FIG. 9(*c*) rotates clockwise against the rotating housing 42. This means that the phase of the intake side cam shaft 19 is in timing advance against the phase of intake side timing pulley 21, i.e., a timing advance control is realized.

According to the first embodiment of the present invention, as explained, the plunger 56, which locks the housing 42 of the actuator 40 to the rotor 42 when the engine is stopped and releases the locking when the engine starts, has a protruding part 56*a*, which is a parallel pin having no tapered surface. As a result, the reaction to the cam shaft when the engine starts exerts almost no influence on the plunger 56. Thus, the inclination of falling out of the plunger 56 from the engaging hole 55 decreases.

Additionally, because the protruding part 56*a* of the plunger 56 has no tapered surface, the clearance between the protruding part 56*a* and the engaging hole 55 when engaged can be reduced compared to the case when the pin is a tapered pin. Consequently, no humming of the rotor occurs when the engine is started. Thus, unpleasant noise when the engine is started can be avoided.

Embodiment 2

Figure 10:
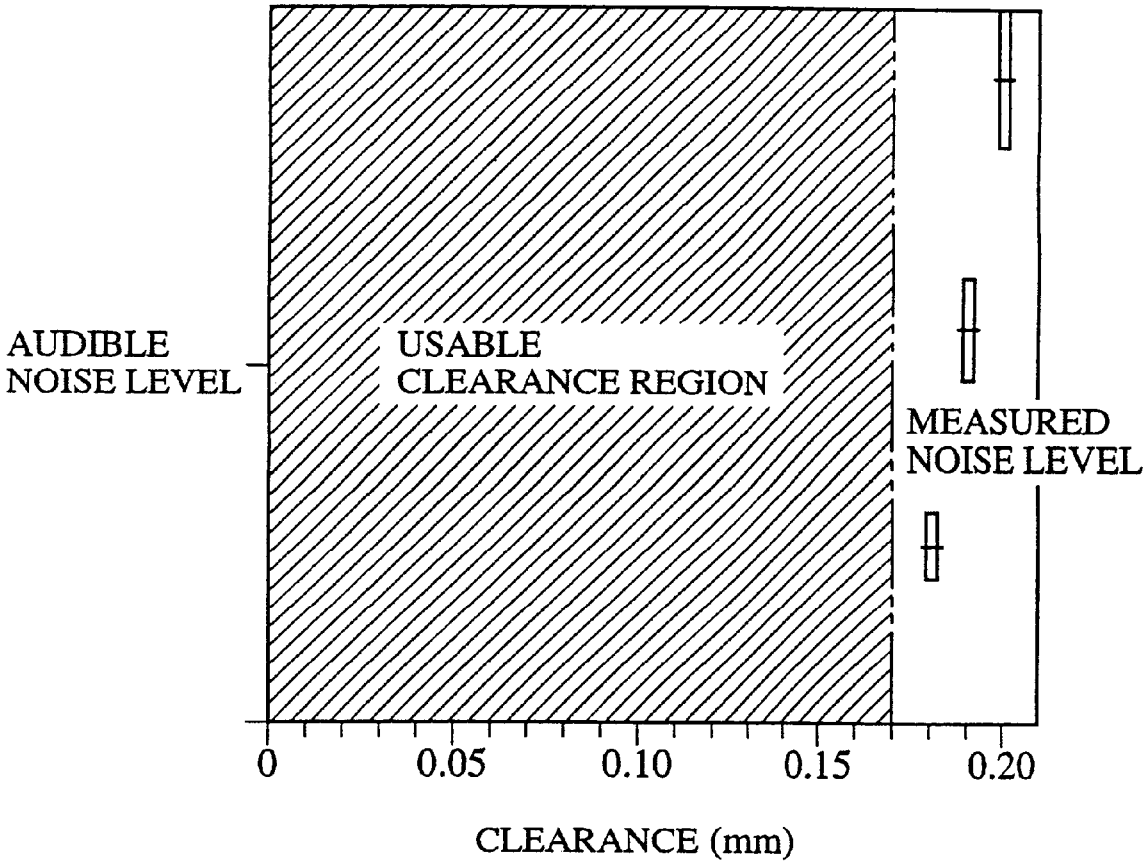
FIG. 10 is a graph, for explaining the operation of the second embodiment of the present invention, showing the characteristics of the noise level in respect to the clearance between the plunger and its engaging hole, when the plunger is in the hole and is engaging therewith.

FIG. 10 is a graph for explaining the operation of the second embodiment of the present invention, showing the characteristics of the noise level with respect to the clearance between the plunger and its engaging hole, when the plunger is in the hole and is engaging therewith. The ordinate represents the clearance, and the abscissa represents the measured value of the generated noise level. The figure shows that at the clearance greater than 0.17 mm, the generated noise levels are found in the audible region. When the clearance decreases to 0.17 mm, the level decreases accordingly. In addition, when the clearance is smaller than 0.17 mm, the level is in the inaudible region.

In this embodiment, the clearance between the plunger 56 and the engaging hole 55 at their engaging state is set to be smaller than 0.17 mm. By setting the clearance to be smaller than 0.17 mm, the assembling precision or the manufacturing precision can be improved. In addition, the unpleasant noise can be avoided.

As explained in detail, according to the first embodiment of the present invention, the plunger has a protruding part 56*a*, which has a constant diameter at the whole engaging region and is in parallel with the cam shaft, that is to say, it has no tapered surface. As a result, the reaction to the cam shaft when the engine starts does not exert any influence on the plunger 56. Thus the detaching of the plunger 56 from the engaging hole decreases.

Additionally, because the protruding part of the plunger has no tapered surface, the clearance between the protruding part and the engaging hole at their engaging state can be made small compared to the case when the pin is a tapered pin. Consequently, humming of the rotor when the engine is started does not occur. Thus, unpleasant noise when the engine starts can be avoided.

According to the second embodiment of the present invention, the clearance between the plunger and the engaging hole at their engaging state is set to be smaller than 0.17 mm. By setting the clearance to be smaller than 0.17 mm, the assembling precision or the manufacturing precision can be improved, as well as unpleasant noise can be avoided.

What is claimed is:

1. A hydraulic apparatus for adjusting the timing of opening and closing of an engine valve comprising:

a cam shaft driven to rotate in synchronization with engine rotation;

an actuator installed on said cam shaft for changing said timing of opening and closing of a valve using a control of a working oil supply to change said timing of opening and closing of the intake valve and/or the exhaust valve;

a slidable, nontapered plunger disposed in said actuator;

a rotor, having an engaging hole therein, which is disposed in said actuator and is operative to engage with said plunger by said engaging hole; and a spring to urge said plunger to move into said engaging hole to make an engagement therebetween when the engine is stopped, and when the engine begins to run, said working oil is supplied into said engaging hole to push out said plunger from said engaging hole to release the engagement between a housing of said actuator and said rotor;

wherein said engaging hole and said plunger have a surface parallel with a slide direction of said plunger, and a clearance therebetween is smaller than 0.17 mm to prevent a hunting of said rotor when said engaging hole and said plunger engage each other.

2. A hydraulic apparatus for adjusting said time of opening and closing of said engine valve according to claim 1, wherein said slide direction of said plunger is parallel with a direction of said cam shaft.

3. A hydraulic apparatus for adjusting said timing of opening and closing of said engine valve according to claim 1, wherein said plunger is installed in said housing, and said engaging hole is disposed in said rotor.

4. A hydraulic apparatus for adjusting said timing of opening and closing of said engine valve according to claim 1, wherein said plunger has a recess at the tip portion.

5. A hydraulic apparatus for adjusting said timing of opening and closing of said engine valve according to claim 1, wherein a whole surface of said engaging hole engaging with said plunger is parallel with said slide direction of said plunger.

* * * * *